United States Patent [19]

Mayfield, III

[11] Patent Number: 5,072,997

[45] Date of Patent: Dec. 17, 1991

[54] DISPENSER

[75] Inventor: John T. Mayfield, III, Clarkston, Ga.

[73] Assignee: The Meyer Company, Cleveland, Ohio

[21] Appl. No.: 594,092

[22] Filed: Oct. 9, 1990

[51] Int. Cl.[5] ..... A47F 3/02

[52] U.S. Cl. ..... 312/35; 312/124; 312/72

[58] Field of Search ..... 312/4, 5, 6, 45, 35, 312/121, 124, 72, 91, 117; 211/10, 12

[56] References Cited

U.S. PATENT DOCUMENTS

| | | | |
|---|---|---|---|
| D. 129,534 | 9/1941 | Maurer . | |
| D. 152,428 | 1/1949 | Lazer . | |
| D. 242,682 | 12/1976 | Cain et al. . | |
| 533,963 | 2/1895 | Northcutt . | |
| 667,081 | 1/1901 | Gentner . | |
| 782,430 | 2/1905 | Tone . | |
| 1,023,116 | 4/1912 | Bailey . | |
| 1,541,659 | 6/1925 | Ramsay | 312/221 |
| 1,616,693 | 2/1927 | Havighorst | 211/10 |
| 1,706,298 | 3/1929 | Jelks et al. . | |
| 1,802,060 | 4/1931 | Neely . | |
| 2,044,231 | 6/1936 | Smith . | |
| 2,364,231 | 12/1944 | MacNeil | 312/72 |
| 2,371,845 | 3/1945 | Robison . | |
| 3,194,620 | 7/1965 | Sauer . | |
| 3,306,688 | 2/1967 | Domenico . | |
| 3,371,795 | 3/1968 | Rosonke . | |
| 3,404,927 | 10/1968 | Mellion . | |
| 3,574,528 | 4/1971 | Siano | 312/35 |
| 3,858,757 | 1/1975 | Langdon, Jr. . | |
| 4,676,371 | 6/1987 | Byrne | 312/72 |
| 4,874,210 | 10/1989 | Carroll | 312/121 |
| 4,909,578 | 3/1990 | Abrate | 312/45 |
| 4,917,264 | 4/1990 | Gasiel et al. | 312/72 |

*Primary Examiner*—Kenneth J. Dorner
*Assistant Examiner*—Gerald D. Anderson
*Attorney, Agent, or Firm*—Kilpatrick & Cody

[57] ABSTRACT

Dispensers for dispensing condiment packages and other articles. Such dispensers feature a front surface that contains a vertical succession of openings. Each opening dispenses a particular type of article, and is fed with articles that are supported by a curved floor that extends from adjacent the bottom of the opening upward and backward to the top area of the dispenser. The top surface of the dispensers may be positioned to open easily and thus allow easy access for loading and cleaning. The resulting dispensers economize on counter space, maintenance costs, and cleaning costs, and present condiment packages and other articles in an attractive, functional fashion.

21 Claims, 2 Drawing Sheets

DISPENSER

The present invention relates to dispensers for dispensing articles such as condiment packages.

BACKGROUND OF THE INVENTION

Condiments such as mustard, mayonnaise, ketchup, soy sauce, and similar foods are conventionally provided in small plastic packages. Recent developments in food service technology have made it more profitable for fast food restaurants to dispense such condiment packages, as well as soft drinks, flatware, napkins and seasonings, directly to the consumer rather using employees to provide such materials. The condiment packages must be, however, readily available to the consumer in an attractive presentation and in a manner which is also convenient to the food service establishment. A conventional manner of providing packaged condiments is to use a number of rectangular bowls in a table, each of which contains a condiment of a certain type. This approach obviously requires counter space for each condiment that is provided, and is therefore inefficient. Such bowl dispensers must include large horizontal surface area in order to provide a sufficient quantity of each condiment without being so deep that the customer fails to see the condiment when the supply is low, or is inconvenienced by reaching into the dispenser. Foreign objects or material also may tend to fall into such dispensers and soil or spoil the presentation.

SUMMARY OF THE INVENTION

The present invention provides a dispenser for condiment packages and similar articles (herewith sometimes referred to as "condiment packages" or "condiments") in which the condiment packages are presented to the user in a vertical succession of openings on a vertical front surface. The dispenser is relatively narrow in width and thus saves counter space, while presenting condiment packages in an attractive and efficient manner.

Condiment packages are fed to each opening by a curved floor which extends from adjacent the bottom of the opening in a backward and upward direction, to a position in the top of the dispenser. The top surface of the dispenser may be opened to allow condiments to be loaded through the top of the dispenser onto the floor for a particular opening or openings.

The curved floors of the dispenser, together with the front surface, may be easily removed for cleaning. The removability of these components is particularly desireable when the dispenser is used for condiment packages, which may leak and require frequent cleaning of the dispenser. Since such cleaning is often provided on an overtime basis in food service establishments, the removability of these services lends further efficiency to the dispenser.

It is therefore an objection of the present invention to provide an efficient dispenser for condiment packages and similar articles which presents such articles to the consumer in a vertical succession of openings.

It is a further object of the present invention to provide an efficient dispenser for condiment packages and similar articles which may be easily and readily cleaned.

It is an additional object of the present invention to provide a dispenser for condiment packages and similar articles which is formed of stainless steel, is inexpensive to manufacture, efficiently utilizes counter space, is easily maintained, and easily loaded.

Other objects, features and advantages of the present invention will become apparent with reference to the remainder of this document.

DETAILED DESCRIPTION OF THE DRAWINGS

Figure 1:
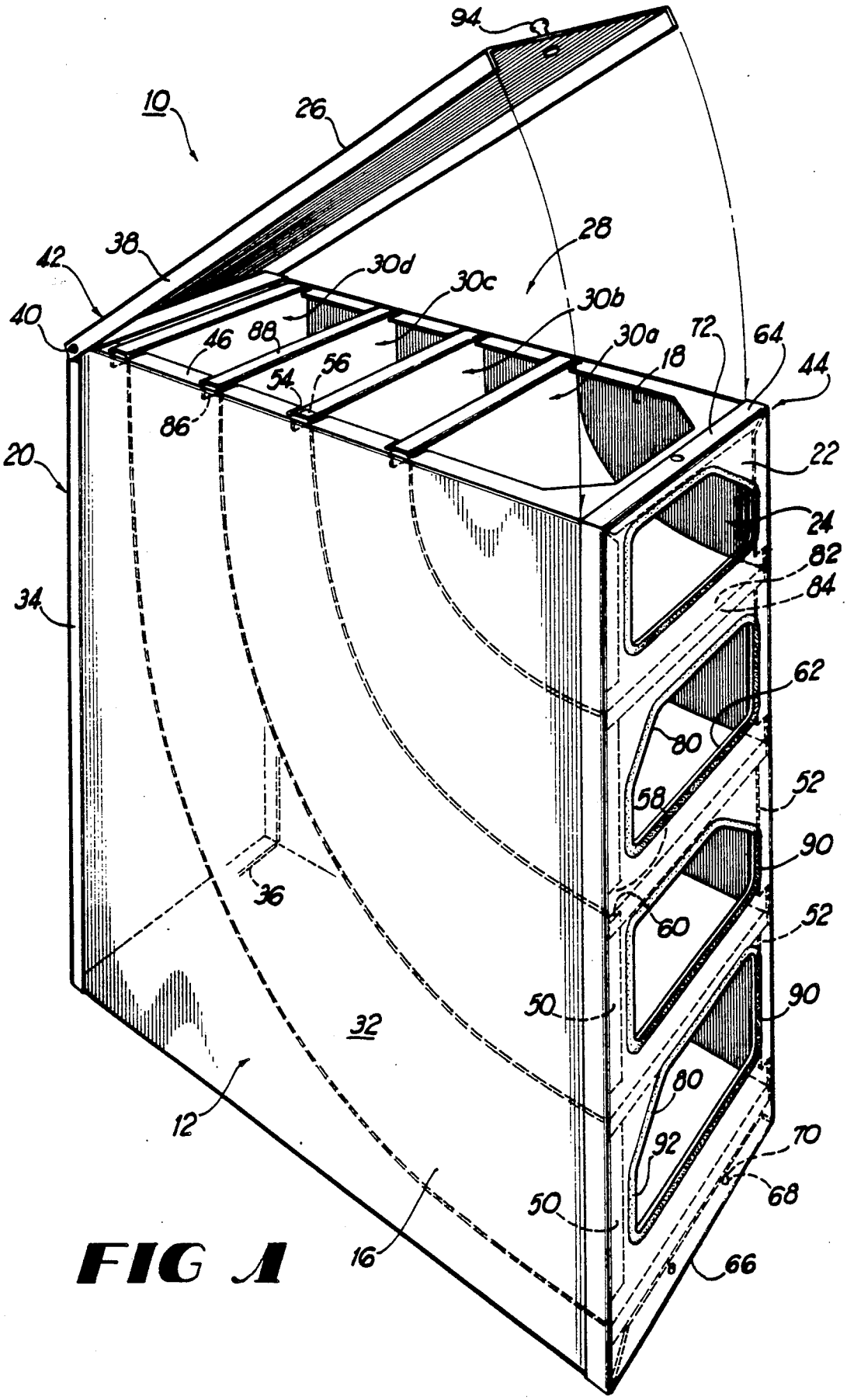
FIG. 1 is a perspective view of a preferred embodiment of a dispenser according to the present invention.

FIG. 1 shows a perspective view of a preferred embodiment of dispenser 10 according to the present invention. Dispenser 10 is preferably formed of an enclosure 12 having a bottom surface 14, two side surfaces 16 and 18, and a back surface 20. A front surface 22 is attached to bottom surface 14 and side surfaces 16 and 18 of enclosure 12, and includes one or more openings 24 through which articles may be dispensed. A top surface 26 is attached to enclosure 12 so that it ca be easily positioned to open the top area 28 of dispenser 10 for loading, cleaning, and whenever else desired. A number of flexible members or floors 30 extend from adjacent the bottom of each opening 24 on front surface 22, upward and backward into the top area 28 of dispenser 10, so that condiment packages may be loaded into the top area of stopper 28 of dispenser 10 and easily reposition themselves as they are dispensed from an opening 24.

Bottom surface 14 and side surfaces 16 and 18 may be easily formed from a single sheet 32 of material which is bent at right angles to form side surfaces 16 and 18. Stainless steel is preferably used to form the surfaces of dispenser 10, but other materials such as plastics may also be used as desired.

Back surface 20 may be formed as part of sheet 32 which is welded or otherwise fastened to bottom surface 14 and side surfaces 16 and 18 as desired. In the preferred embodiment, however, back surface 20 is formed of a separate sheet of material with contiguous side tabs 34 and bottom tab 36 for fastening to bottom surface 14 and side surfaces 16 and 18. Spot welding or other conventional joining or fastening techniques may be used.

Top surface 26 is preferably formed of another sheet of material, which preferably features contiguous tabs 38 bent at right angles to overlie (or underlie, if desired) portions of side surfaces 16 and 18. Top surface 26 is preferably mounted using rivets or pins 40 to form a hinge connection with the back top corner 42 of enclosure 12. The rivets or pins 40 may extend through portions of back surface 20 or side surfaces 16 and 18 or all of them, as desired. Top surface 26 may thus be easily opened to expose top area 28 of dispenser 10. Just as easily, top surface 26 could be attached via a hinge or other desired arrangement to the front top corner 44 of enclosure 12, or positioned on top area 28 of enclosure 12 in any other manner that allows that area to be exposed for loading, cleaning, and when otherwise desired.

Side surfaces 16 and 18 of enclosure 12 also preferably feature top tabs 46 and 48 and front tabs 50 and 52, as shown in FIG. 1. These tabs are particularly useful for mounting flexible members or floors 30. They are preferably formed by bending portions of side surfaces 16 and 18 perpendicularly into place, so that top tabs 46 and 48 ar substantially parallel to bottom surface 14 and front tabs 50 and 52 are substantially perpendicular to side surfaces 16 and 18 and bottom surface 14.

Each top tab 46 and 48 preferably contains a number of cutouts 54 which act in pairs to form a number of teeth 56. Similarly, each front tab 50 and 52 preferably contains a plurality of cutouts that form a plurality of lips 60, each of which lips 60 corresponds to a particular opening 24 in front surface 22. Lips 60 are preferably located below the bottom edge 62 of each opening.

Figure 4:
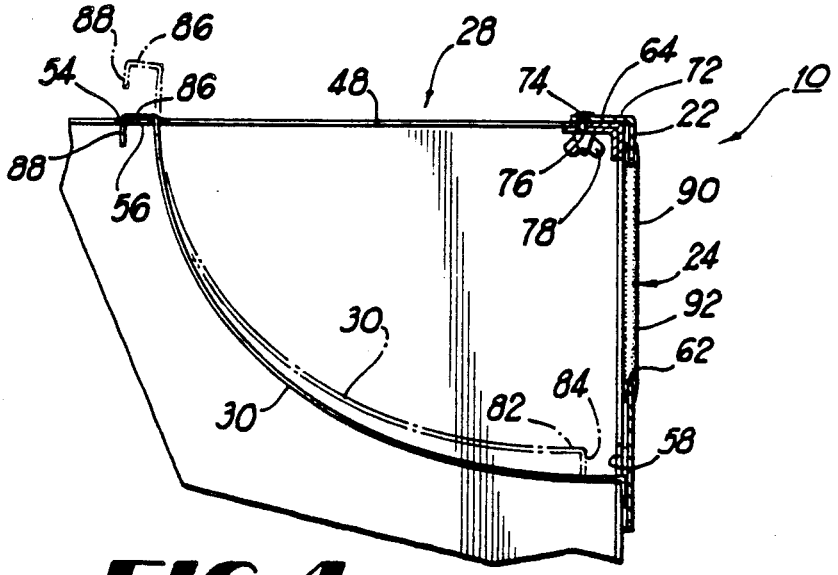
FIG. 4 is a partial side cross-sectional view of the of FIG. 1.

Front surface 22 is preferably formed of yet another sheet of material in which openings 24 are formed as desired and which is formed to include peripheral skirts as desired to overlie or underlie portions of top area 28, side surfaces 16 and 18 and bottom surface 14 as desired. Front surface 22 is also preferably adapted to be easily removed from enclosure 12 for easy access and cleaning. In the preferred embodiment as shown in FIG. 1, bottom portion 66 of skirt 64 contains a pair of holes 68 which capture rivets 70 that extend from bottom surface 14. The top portion 72 of skirts 64 contains a hole which is substantially aligned with another hole 76 in one or more top tabs 46 and 48 of side surfaces 16 and 18, to receive a wing nut 78 or other fastener as desired, as shown in FIG. 4. Front surface 22 may be otherwise attached to enclosure 12 as desired in order to be easily removable if desired.

Each opening 24 in front surface 2 is preferably rectangular in shape, having one corner truncated to form a fifth side 80. Fifth side 80 often proves useful when the portion of the dispenser corresponding to the opening 24 is fully loaded; the occluded corner often retains condiment packages or other articles where they would otherwise tumble from openings 24.

Figure 2:
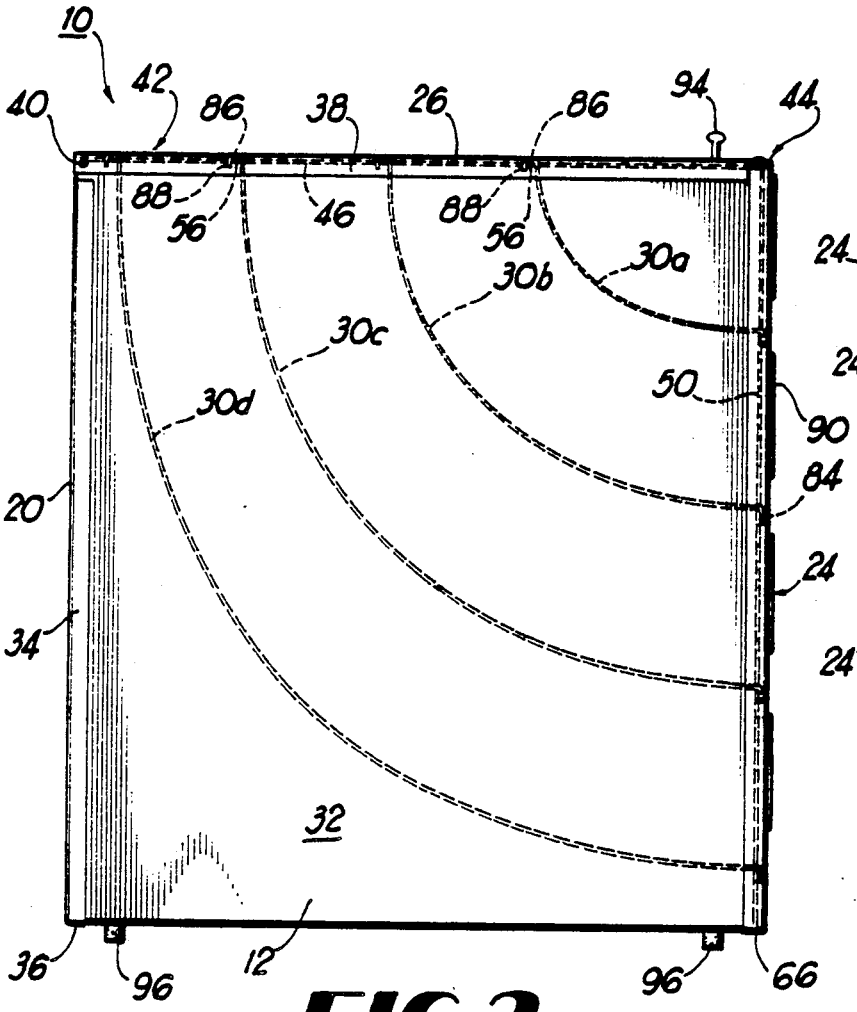
FIG. 2 is a side elevational view of the dispenser of FIG. 1.

Each opening 24 is fed with condiment packages or other articles (not shown) that are supported with a flexible member or floor 30. Each flexible member or floor 30 may be formed of stainless steel or other flexible material. A first end of each floor 30 contains a tab 84 which is preferably bent perpendicular to floor 30 to be captured by a corresponding lip 60 corresponding to an opening 24. The other, second end 86 of floor 30, is preferably fitted with a second tab 88 which may simply be a portion bent perpendicular to floor 30 or, as shown in FIGS. 1, 2 and 4, bent twice to form a substantially j-shaped cross section. In this fashion, second ends 86 of floors 30 may be suspended over teeth 56 of top tabs 46 and 48, and tabs 84 on first ends 82 of floors 30 may be captured by lips 60 formed in front tabs 50 and 52. Other forms of retainers may also easily be used for supporting first and second ends 82 and 86 of floor 30. For instance, rivets could be placed inside surfaces 16 and 18 to capture substantially j-shaped cross sectioned tabs in second ends 86 and floors 30, while rivets or lips or other retainers formed in the back of front surface 22 could support first ends 82 of floors 80. It is an essential aim of the invention to provide flexible floors 30 which are securely suspended at a vicinity adjacent corresponding openings 24 and the top area 28 of dispenser 10, when dispenser 10 is in use, but which may be easily removed for cleaning and when otherwise desired. The present invention thus includes any particular structure which accomplishes these objectives.

Figure 3:
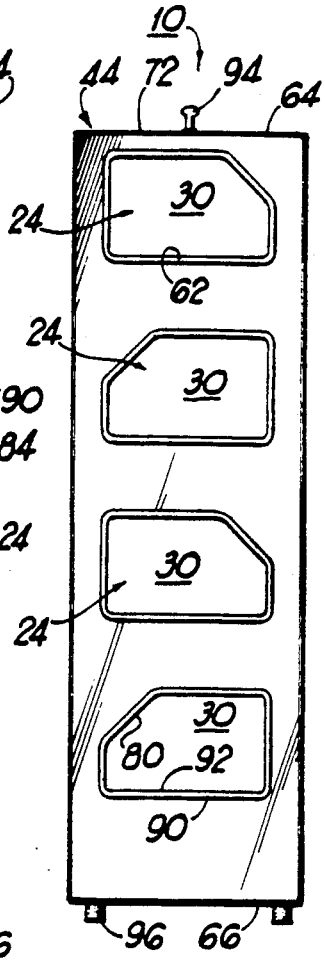
FIG. 3 is a front elevational view of the dispenser of FIG. 1.

FIGS. 1, 3 and 4 also show a plastic or other guard 90 protecting the edges 92 of openings 24. Guards 90 may be formed of plastic or other desired materials and of varying colors for attractiveness.

Dispensers 10 of the present invention may be fitted with knobs 94 on top surface 26, and feet 96 on bottom surface 14, both of conventional structure as desired. Dispenser 10 is preferably dimensioned to accommodate condiment packages, but it may be formed of any particular dimensions and materials to accommodate other items or articles as desired.

The foregoing disclosure is provided for purposes of illustration and explanation. Modifications may be made to the mechanical structures recited without departing from the scope or spirit of the invention.

What is claimed is:

1. A dispenser, comprising:

a an enclosure formed of a bottom surface, a back surface, and two side surfaces;

b. a front surface attached to the bottom and side surfaces, which contains at least one opening through which articles stored in the dispenser may be dispensed;

c. a top surface attached to the back, side and front surfaces, which may be positioned to open the top of the dispenser when desired;

d. a first retainer located adjacent to the bottom of each opening in the front surface;

e. a second retainer connected to the top of each side surface; and f. a flexible member having a mean forming a discontinuity at each end, the discontinuity at the first end adapted to cooperate with a retainer in the front surface and the discontinuity in the second end adapted to cooperate with the corresponding second retainer in the side surfaces, in order to form a removable floor for articles to be dispensed through the opening adjacent to the retainer in the front surface with which the member's first end discontinuity cooperates.

2. A dispenser according to claim 1 whose front surface contains two or more openings.

3. A dispenser according to claim 2 in which the first retainers located adjacent to openings in the front surface are connected to the front surface.

4. A dispenser according to claim 2 in which the first retainers located adjacent to openings in the front surface are connected to the side surfaces.

5. A dispenser according to claim 4 in which each side surface includes a tab that is bent substantially perpendicular to the side surface, which tab contains a plurality of cutouts to form the first retainer for each of the openings in the front surface.

6. A dispenser according to claim 2 in which each side surface includes a tab that is bent substantially parallel to the bottom surface, which tab contains a plurality of cutouts to form the second retainers corresponding to the first retainers.

7. A dispenser according to claim 1 in which the flexible member end discontinuities are tabs bent substantially perpendicular to the flexible member.

8. A dispenser according to claim 7 in which the flexible member second end discontinuity is substantially J-shaped in cross section.

9. A dispenser, comprising:

a. an enclosure formed of a bottom surface, a back surface, and two side surfaces;

b. a front surface attached to the bottom and side surfaces so that it may be removed when desired, which contains at least two openings through which articles stored in the dispenser may be dispensed;

c. a top surface attached to the back, side and front surfaces, which may be positioned to open the top of the dispenser when desired;

d. a tab on each side surface that is bent substantially perpendicular to the side surface, which tab contains a plurality of cutouts to form a lip retainer for each of the openings in the front surface;

e. a tab that is bent substantially parallel to the bottom surface, which tab contains a plurality of cutouts to form suspending retainers corresponding to the front surface retainers; and f. a plurality of removable flexible members, each for forming a curved floor within the dispenser for articles to be dispensed through a front surface opening, each having a first end tab for being captured by a front opening lip retainer, and a second end tab for being captured by one of the suspending retainers.

10. A dispenser according to claim 9 in which the top surface is connected to the enclosure to pivot with respect to the enclosure.

11. A dispenser according to claim 9 in which the second end tab of each flexible member is substantially J-shaped in cross section.

12. A dispenser according to claim 9 whose dimensions are adapted to accommodate condiment packages.

13. A dispenser according to claim 9 formed of stainless steel.

14. A dispenser according to claim 9 formed of plastic materials.

15. A dispenser, comprising:

a. a first sheet of material shaped to form a bottom surface, two side surfaces, a top tab extending from each side surface substantially parallel to the bottom surface, and a front tab extending from each side surface substantially perpendicular to the side and bottom surfaces;

b. a back surface attached to the bottom and two side surfaces;

c. a top surface connected to the top rear corner of each side surface to pivot with respect to the side surfaces;

d. a front surface attached to the bottom surface and top tabs of the side surfaces so that it may be removed when desired, and having a number of openings through which articles may be dispensed;

e. a plurality of cutouts formed in the front tabs, in order to provide a lip in the front tab for each front opening;

f. a plurality of cutouts formed in the top tabs, in order to provide a tooth corresponding to each front tab lip;

g. a removable flexible member corresponding to each front opening to provide a curved floor for articles to be dispensed through the front opening, which floor extends from the lip corresponding to that opening to the tooth in the top tab corresponding to that lip, and whose first end includes a first end tab for being captured by front tab lip, and whose second end includes a second end tab for being suspended by the top tab tooth.

16. A dispenser according to claim 15 in which the teeth are formed in the top tab at a distance from the front top corner of the side surfaces substantially the same distance as that at which their corresponding lips ar formed in the front tab.

17. A dispenser according to claim 15 in which the openings in the front surface are substantially rectangular in shape with one corner partially occluded to form a fifth side.

18. A dispenser according to claim 15 whose dimensions are adapted to accommodate condiment packages.

19. A dispenser according to claim 15 in which each front surface opening is fitted with a guard to cover its periphery.

20. A dispenser according to claim 15 in which said surfaces and flexible member are formed of stainless steel.

21. A dispenser according to claim 15 in which said surfaces and flexible member are formed of plastic.

* * * * *

UNITED STATES PATENT AND TRADEMARK OFFICE

CERTIFICATE OF CORRECTION

PATENT NO. : 5,072,997

DATED : December 17, 1991

INVENTOR(S) : John T. Mayfield, III

It is certified that error appears in the above-identified patent and that said Letters Patent is hereby corrected as shown below:

Column 2, line 14, after "the" insert --dispenser--
Column 2, line 27, delete "ca" and insert --can--
Column 3, line 7, delete "ar" and insert --are--
Column 3, line 34, delete "2" and insert --22--
Column 4, line 33, delete "mean" and insert --means--
Column 6, line 29, delete "ar" and insert --are--

Signed and Sealed this

Twenty-seventh Day of April, 1993

*Attest:*

MICHAEL K. KIRK

*Attesting Officer*

*Acting Commissioner of Patents and Trademarks*